US005249589A

United States Patent [19]

Moore

[11] Patent Number: 5,249,589

[45] Date of Patent: Oct. 5, 1993

[54] METHOD FOR SETTING A HAIR TWIST

[76] Inventor: Melanie Moore, 243 W. 76th St., New York, N.Y. 10023

[21] Appl. No.: 966,332

[22] Filed: Oct. 26, 1992

[51] Int. Cl.[5] ..... A45D 7/00

[52] U.S. Cl. ..... 132/210

[58] Field of Search ..... 132/200, 210, 219, 137, 132/144

[56] References Cited

U.S. PATENT DOCUMENTS

| | | | |
|---|---|---|---|
| 235,571 | 12/1880 | Prevear | 132/219 |
| 1,695,983 | 12/1928 | Saito | 132/219 |
| 2,299,770 | 10/1942 | Solomon | 132/137 |
| 2,446,781 | 8/1948 | Norin | 132/137 |
| 2,454,642 | 11/1948 | Finman | 132/144 |
| 3,292,641 | 12/1966 | Quintanar | 132/210 |
| 3,889,692 | 6/1975 | Redrow | 132/210 |
| 4,522,215 | 6/1985 | Verducci | 132/219 |

FOREIGN PATENT DOCUMENTS

| | | | |
|---|---|---|---|
| 874948 | 4/1953 | Fed. Rep. of Germany | 132/219 |
| 2545337 | 11/1984 | France | 132/210 |

*Primary Examiner*—Gene Mancene
*Assistant Examiner*—Todd E. Manahan
*Attorney, Agent, or Firm*—Baker & Friedman

[57] ABSTRACT

A method of setting hair including the steps of pulling a full handful of the hair back at the nape of the neck, making a twist going up against the back of the head, making a plurality of twists against the head and moving them upward toward the top of the head and into a roll having an edge. The top of the plurality if twists is then pinched so the roll will not loosen up and pushing the remaining hair under the roll. A particular hair comb is then placed, at a 90 degree angle to the head into the edge of the roll. Finally the top of the comb is turned down toward the head while the comb teeth are pushed into the roll. This new method of setting hair allows a person or a hair stylist to set hair in a neat, consistent and appealing fashion. This simple to learn method is cost effective and only requires a hair comb.

4 Claims, 2 Drawing Sheets

METHOD FOR SETTING A HAIR TWIST

FIELD OF THE INVENTION

This invention generally relates to a new and improved method for setting a hair twist. More specifically, but not by way of limitation, the present invention relates to a previously unknown yet simple method for setting hair into a french twist hair style. Present hair styles vary greatly and depend much on the professional abilities of the particular hair stylist. When seeking to have ones hair shaped into a particular design, such as a hair bun, a bouffant style or a french twist, as in the present invention, a consumer is presently subject to the personal taste and design of the person who is about to set their hair. This depends much on the designer's experience and knowledge in the field. Unfortunately, however, there has never been disclosed to the hair design industry a precise and simple method of stylishly and proficiently setting a consumer's hair into a clean elegant looking french twist or bun. In the past a consumer, often at substantial costs, was not satisfied at the hit or miss results obtained in the setting of their hair. In avoiding these difficulties of the prior art, the present invention not only provides a consistent way of setting a french twist, but also due to its effective and effortless to learn method, is cost effective. This new and unobvious disclosure gives birth to the creation of a way of setting hair into an attractive and predictable way.

DESCRIPTION OF THE PRIOR ART

There are various patents on methods for curling, waving, and setting hair but all have limiting features which do not make the presently disclosed method obvious. In view of the limitations associated with the prior art, the need for a consistent and effortless method for setting a twist is herein disclosed. The present invention is viewed as providing a new and expensive way of setting a hair twist.

A prior art search, discloses eight patents dealing with methods and apparatus for setting, curling or twisting hair. The most relevant were U.S. Pat. No. 3,482,582; U.S. Pat. No. 3,451,398; and U.S. Pat. No. 3,420,246. Although generally relevant to the art of hair styling, none of these prior art patents disclose the new method of setting hair into a stylish hair twist as now disclosed herein.

U.S. Pat. No. 3,482,582 by Morgan, also entitled METHOD FOR SETTING HAIR, is dissimilar to the present invention in that it does not have a particular hair comb to hold the roll and twist in place. Thus, the publication of Morgan '582 does not make any references which would have suggested to the person skilled in the art to create a twist in accordance with the disclosure now made.

Although most similar in having the winding a strand of hair, U.S. Pat. No. 3,451,398 to Marcello requires a mandrel and not a hair comb.

Finally, U.S. Pat. No. 3,420,246, METHOD FOR CURLING HAIR, simply discloses coating hair with a water repellent material and subjecting each hair to a bending pressure.

The other five patents: U.S. Pat. No. 3,635,228, U.S. Pat. No. 3,858,590, U.S. Pat. No. 4,998,186, U.S. Pat. No. 5,062,436, and U.S. Pat. No. 5,115,825 were not deemed relevant to the present disclosure.

SUMMARY OF THE INVENTION

This newly disclosed method of setting hair into a twist is a reliable, appealing and stylish for the hair design industry of the 90's. It is an easy to learn method which is cost effective and only requires a single hair comb. The method includes the steps of pulling a handful of hair, back at the nape of the neck, making a twist going up against the back of the head, and then making a plurality of twists, with the remaining hair, against the back of the head and moving said twists upward toward the top of the head and into a roll. The top of the roll is then pinched tightly so the roll will not loosen up. One then pushes the remaining hair under the roll. A wide tooth hair comb is then placed into the edge of the roll at a 90 degree angle to the head. The comb touches the scalp and finally the top of the comb is turned down toward the head while the comb teeth are pushed into the roll. The twist created by this method is now complete.

OBJECTS OF THE INVENTION

It is therefore an object of the present invention to provide a method of setting hair into a twist that is tight and neat in appearance.

A further object of the present invention to provide a method of setting hair into a twist in a way that is simple and consistent and which is aestectically pleasing to the eye.

Another object of the present invention is to provide a method which is performed in conjunction with a novel wide tooth hair comb.

Still a further object of the present invention is to eliminate the uncertainty in results that occurs when setting a hair style.

Other objects, advantages and novel features of the invention will become readily apparent to those skilled in the art from the following detailed description of the invention when considered in conjunction with the attached drawings wherein like reference numbers identify like parts throughout.

DETAILED DESCRIPTION OF THE INVENTION

Figure 1:
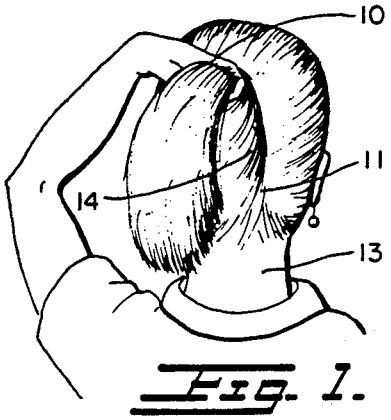
FIG. 1 illustrates the step of pulling a full handful of the hair back at the nape of said neck, holding of the hair in one hand and then making a large twist going up against the back of the head.
Figure 2:
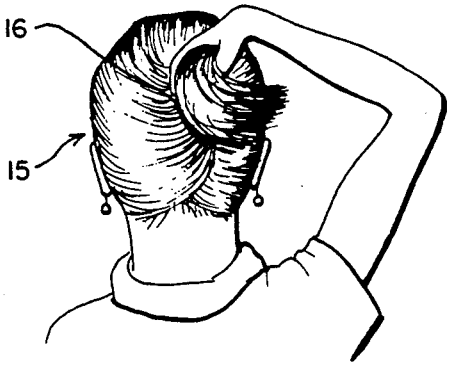
FIG. 2 illustrates the step of making a plurality of twists against the head and moving it upward toward the top of the head and into a roll.
Figure 3:
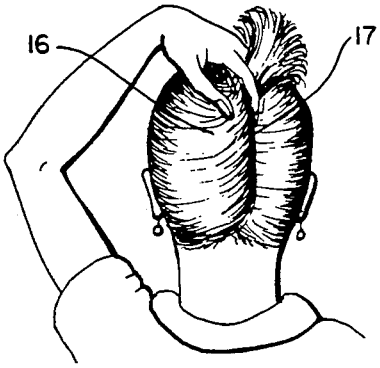
FIG. 3 illustrates the step of pinching the top of the second twist so the roll will not loosen up.
Figure 4:
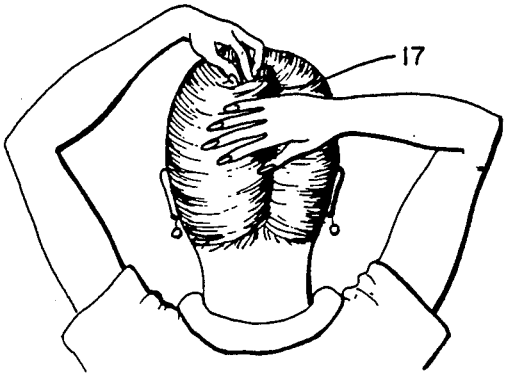
FIG. 4 illustrates the step of bringing all the remaining hair [not in the first or second twist] under the roll, and then pushing said remaining hair under the roll.
Figure 5:
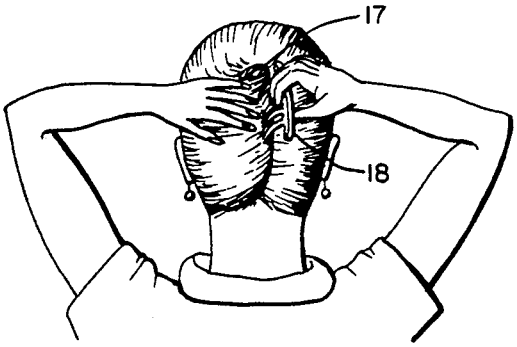
FIG. 5 illustrates the steps of a) keeping pressure on the roll so that it does not pop loose, b) placing a comb, having teeth at one end and a top part at the other, into the edge of the roll, at its teeth, at a 90 degree angle to the head, and then c) turning the top part of the comb down toward the head.
Figure 6:
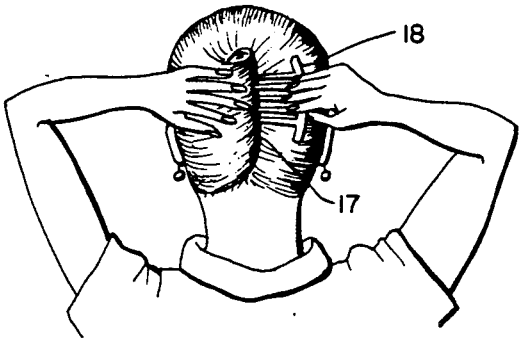
FIG. 6 illustrates the step of pushing the comb into the roll.
Figure 7:
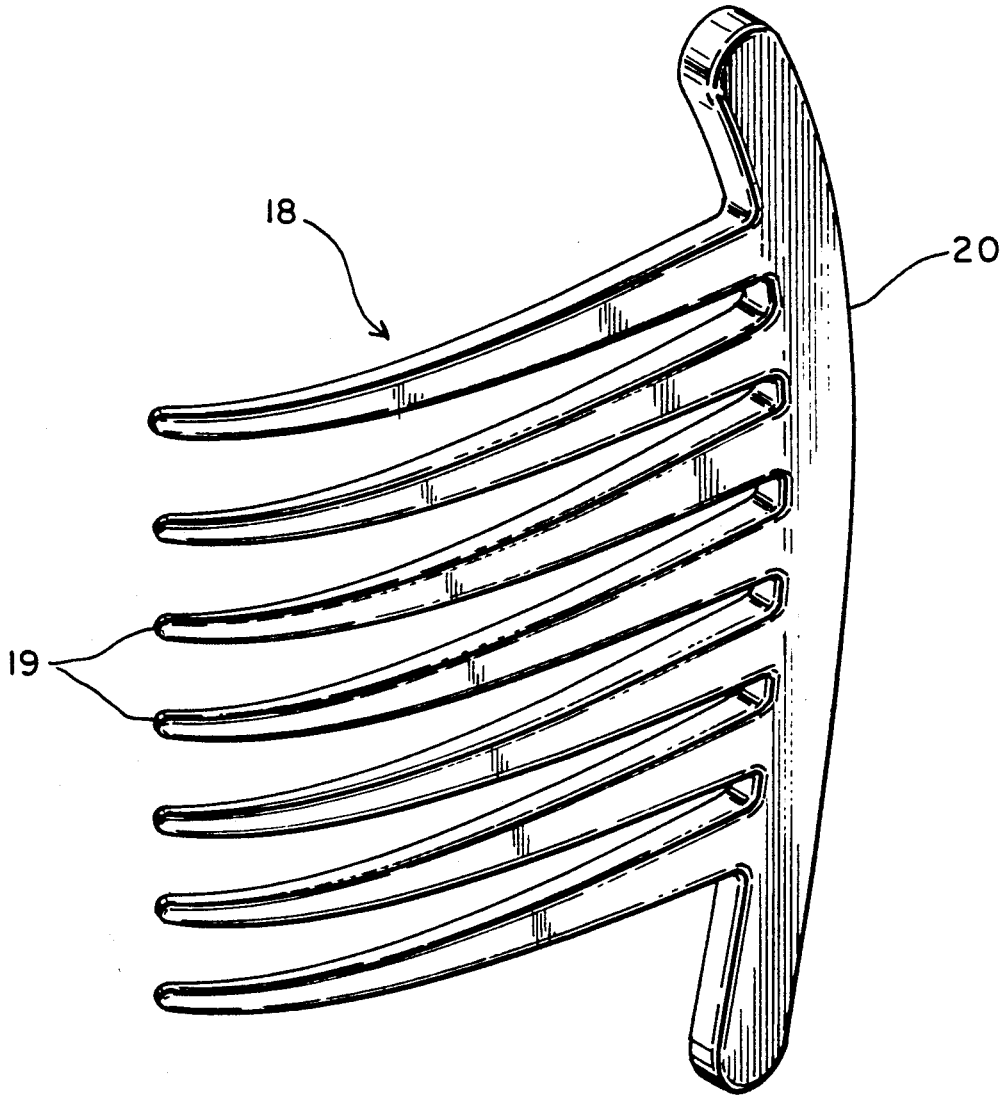
FIG. 7 is a perspective view of the wide toothed hair comb to be used in conjunction with the method disclosed herein.

The resulting advantages and ease of setting ones hair into a twist, according to the present invention, can perhaps be best explained and understood by reference to the drawings, wherein like reference numerals have been used throughout the various Figures, to designate corresponding steps and parts. Referring now more specifically to the preferred embodiment of steps shown in FIGS. 1–6, the first FIG. 1 illustrates the step of pulling a handful of the hair 10 back at the nape 11 of the persons neck 13 and holding of the hair 10 in one hand and then making a large twist 14 going up against the back of the head 15. FIG. 2 illustrates the step of making a second twist 16 against the head 15 and moving it upward toward the top of the head 15 and into a roll 17. In FIG. 3 the second twist 16 of hair 10 is pinched so the roll 17 will not loosen up. As shown in FIG. 4 all the remaining hair 10 not in the first or second twist 14, 16 is then pushed under the roll 17. Next, as shown in FIG. 5, first pressure is kept on the roll 17 so that the roll 17 does not loosen up and then a wide tooth hair comb 18 is placed into the edge of the roll 17, at its teeth 19, at a 90 degree angle to the head 15, after which the top part of the hair comb 20 is pushed down toward the head 15. As shown in FIG. 6 the hair comb 18 is pushed into roll 17.

The advantages and benefits of the present invention are many. For example, the method according to the present invention is relatively simple, and can be easily learned to consistently obtain an attractive hair style.

Since the invention is described and illustrated with reference to but a single, preferred embodiment, and since numerous modifications and changes will become readily apparent to those skilled in the art after reading this disclosure, it should be understood that I do not wish to limit the scope of my invention to the method described above, and as claimed by me below.

I claim:

1. A method for setting a hair twist on a head having hair on its top and a neck at its bottom, comprising the steps of:

pulling a full handful of hair back at the nape of said neck;

holding of said hair in one hand;

making a large twist going up against the back of the head;

making a plurality of twists against the head and moving it upward toward the top of the head and into a roll having an edge;

pinching the top of the roll so the roll will not loosen up;

bringing all remaining hair under the roll;

pushing said remaining hair under the roll;

keeping pressure on the roll so that it does not loosen;

placing a hair comb, having wide teeth at one end and a top part at the other, into the edge of the roll, at its teeth, at a 90 degree angle to the head;

turning the top part of the comb down toward the head; and finally pushing the comb into the roll.

2. A method for setting a hair twist as in claim 1 further including the step of making a third twist after making a second twist.

3. A method for setting a hair twist as in claim 2 whereby in the first step less than a handful of hair is pulled back at the nape of the neck.

4. A method for setting a hair twist on a head having hair on its top and a neck at its bottom, comprising the steps of:

pulling a full handful of the hair back at the nape of said neck;

holding of said hair in one hand;

making a large twist near the top of the head;

making a plurality of twists against the head and moving them upward toward the top of the head and into a roll having an edge;

letting the roll stay loose;

making a plurality of twists from the hair ends all the way to the top of the head making a tightened roll having said plurality of twists;

bringing all remaining hair under the roll;

pushing said remaining hair under the roll;

keeping pressure on the roll so that it does not loosen;

placing a hair comb, having wide teeth at one end and a top part at the other, into the edge of the roll, at the top of the head;

turning the top part of the comb down toward the head; and finally pushing the comb into the roll.

* * * * *